United States Patent [19]

Carr

[11] 4,330,130

[45] May 18, 1982

[54] FLYING SAUCER BOWLING GAME

[76] Inventor: J. Richard Carr, 27 Midway Ave., Buffalo, N.Y. 14215

[21] Appl. No.: 106,358

[22] Filed: Dec. 21, 1979

[51] Int. Cl.[3] ..... A63B 67/00

[52] U.S. Cl. ..... 273/393; 273/407; 206/315 R

[58] Field of Search ..... 273/37, 38, 46, 52, 273/393, 407, 411, 424; 206/315 R

[56] References Cited

U.S. PATENT DOCUMENTS

| | | | |
|---|---|---|---|
| 533,102 | 1/1895 | Thomson | 273/407 |
| 1,552,057 | 9/1925 | Jay | 273/393 |
| 1,819,932 | 8/1931 | Walden | 273/118 R X |
| 1,951,894 | 3/1934 | Ziebarth | 273/56 |
| 2,243,620 | 5/1941 | Fernandez | 273/411 X |
| 2,520,392 | 8/1950 | Flenghi | 273/393 |
| 3,201,126 | 8/1968 | Nissen | 273/393 |
| 3,463,490 | 8/1969 | Annessa | 273/37 |

*Primary Examiner*—Anton O. Oechsle
*Attorney, Agent, or Firm*—Raymond F. Kramer

[57] ABSTRACT

A flying saucer bowling game is disclosed in which a player or two or more players scale(s) a flying saucer at a pluraity of positioned pins, supported on a suitable base, with the object being to knock the pins down and make and score strikes and spares, in a manner similar to that of bowling. Within the invention are sets of game items for playing this simulated bowling game, preferred combinations of pins and supports, holders for the game parts and a method of playing the game.

19 Claims, 6 Drawing Figures

FLYING SAUCER BOWLING GAME

This invention relates to a new game which combines elements of bowling and flying saucer scaling. More particularly, it relates to such a game wherein players competitively scale flying saucers at pins in attempts to knock them down so as to make and score strikes and spares.

In the last ten to fifteen years the scaling, tossing and flying of flying saucers has become an important sport and a major source of healthful recreation, enjoyed by young and old alike. Records are maintained for greatest distances scaled, longest times aloft, team and individual scaling and catching, and accuracy of scaling, and trick scaling has been practiced. Competitions of various types have been organized for individuals and teams to test their proficiency in controlling the flying saucers and games have been created in which such saucers or similar scalable items have been used.

In a search in the U.S. Patent and Trademark Office, made at the request of the present applicant, the patents found that are considered to be closest to the present invention are: U.S. Pat. Nos. 2,923,548; 3,976,297; and 4,063,382. The first of these is characterized as an aerial projectile game and in it one throws a specially shaped projectile at a number of similar projectiles, arranged as a target. There is no suggestion in this patent of scaling a flying saucer at pins nor is there any mention of scoring in a manner like that employed in bowling. U.S. Pat. No. 3,976,297 shows a tethered flying disc toy directed at an adjustable net target. U.S. Pat. No. 4,063,382 illustrates a tubular throw ring which is directed at a hook, with the object being to have the hook hold the scaled ring through the ring opening. In addition to the patent art found, applicant has noted a circular of the International Frisbee Association wherein throwing a Frisbee® through a hoop is described and wherein Frisbee Golf is mentioned, in which a flying saucer is scaled around obstacles to hit natural objects, standardized poles or baskets. With respect to another aspect of the present invention, the carrier for the game items, applicant is aware that carriers for arrows have held them parallel to each other in external slots.

Although the prior art indicates that flying saucers and similar articles have been scaled, flung or tossed at targets and that games have been created in which such saucers and similar airborne projectiles have been utilized and although projectiles have been thrown at arranged targets, the prior art does not disclose nor does it suggest the present invention. In accordance with the present invention a set of game items for playing a simulated bowling game in which a flyin saucer is scaled at a target, which target includes a plurality of pins, with the object being to knock down the pins, comprises a flying saucer, a plurality of pins adapted to be placed in upright position on a supporting surface and a support for such pins on which the pins may be positioned and held upright until knocked down by contact with a flying saucer scaled at them by a player of the game. The invention preferably relates to similar sets in which pins and a support for them are provided, for use together with a flying saucer. Also preferably within the invention are such sets wherein: magnetic means or hook and loop means are employed to disengageably hold the pins in position on the support; foldable supports are employed, including pivoting means; and holders are used to hold the pins and pin supports. Also described in the specification are methods of playing the described game.

The invention will be readily understood by reference to this specification, including the following description, taken in conjunction with the drawing in which.

Figure 1:
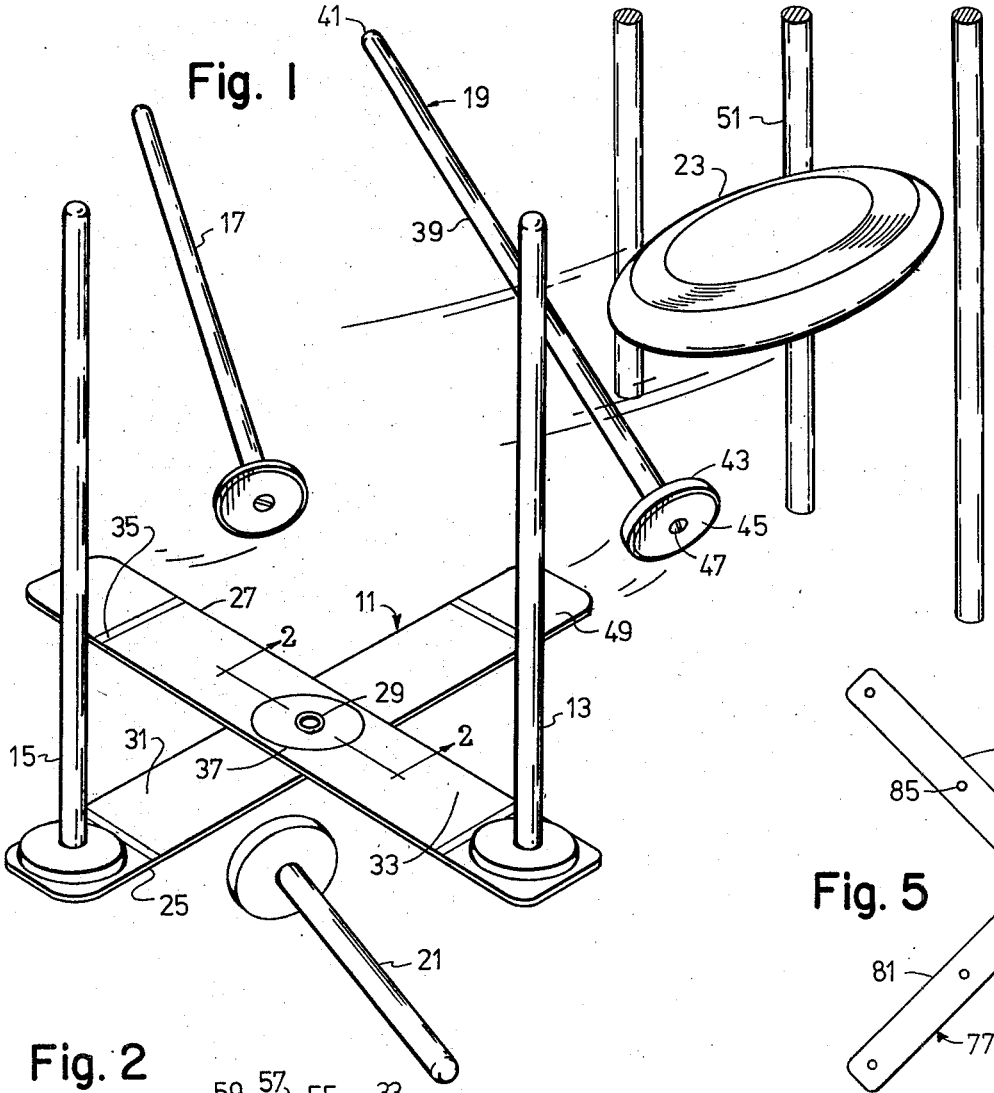
FIG. 1 is a perspective view of an embodiment of the invention wherein five pins are shown together with a supporting base, after a scaled flying saucer has struck two pins and one of them has struck a third pin.

In FIG. 1 there is shown support or supporting base 11, pins 13, 15, 17, 19 and 21, and flying saucer 23. As shown, support 11 is in open position, with the two elongated flat strip portions 25 and 27 thereof, shown in operative position, at right angles, being held together by pivot means 29, the details of which are shown in enlarged FIG. 2. Strips 25 and 27 include supporting upper surface portions 31 and 33, respectively, which are marked near the ends thereof, as at 35, with surface 33 also being marked at 37, to indicate pin mounting locations or areas. Thus, the transverse lines, such as that at 35, may define an area nearer to the ends of the support than such lines, where the respective pins are to be placed. Alternatively, they may be located so that the pins are mounted on them or other markings. Circle 37, which is of a size slightly greater than the pin base, defines the position of the central pin, when it is employed (this optional use will be mentioned later). It will be noted that strips 25 and 27 of support 11 are pivotable about pivot 29 so that they can overlie one another, for ease of packaging, transportation and storage. When not in use support 11 will normally be in such overlying, straight or closed position.

The pins shown will usually be identical but, if desired, may be of different characteristics, such as of different heights and different holding characteristics, with respect to the support for them. The following description of pin 19 will normally apply to the constructions of the other pins, too. The shaft 39 of pin 19 will frequently be a comparatively thin hollow tube having an inserted head 41, preferably rounded, at the top end thereof, a flat bottomed cuplike member 43 at the lower end thereof and an enlarged base portion 45, adapted to be mounted on an end portion of a support strip in complementary relationship therewith, preferably being flat so as to be positionable with its surface against and conforming or substantially conforming to the supporting surface of such strip. Base 45 may be a magnet or of magnetic material which may be magnetically held to a similar magnetic material or magnet at an end of the support, as at 49, so as to retain pin 19 in proper position for playing the game. Alternatively, base 45 may have a lower surface portion of hook or loop material which will be holdable to a loop or hook material at the end of the support, as at 49. Of course, similar holding materials may be present at the center or pivot portion of the support to hold the fifth pin. As illustrated in FIG. 1, screw 47 holds pin base 45 in place inside cup member 43, holding such base and cup to tube 39, preferably by screwing into a plug, not shown, inside the lower end of the tube. However, a solid rod or other substitute pin structure may be employed instead of tube 39, in which case the lower end thereof may be threaded, and screw 47, with matching threads, may be screwed into holding position with respect to such rod. Alternatively, a suitable other fastening means, e.g., adhesive, may be employed to hold the pin parts together.

In FIG. 1, flying saucer 23, preferably of a type such as is illustrated in U.S. Pat. No. 3,359,678 (although other flying saucers may also be employed), is shown after having struck pins 17 and 19 and after pin 17 has struck pin 21, so that, as illustrated, three pins are falling. The path of the flying saucer, as illustrated, is from the left of the drawing, with the cruciform (like the Greek cross or that of St. Andrew) or X-shaped base having been positioned with an open part of the X facing the player. As shown, the saucer struck the left side pins, driving pin 17 into middle pin 21 but not knocking down pins 13 and 15. Thus, the player would then get a second turn, in which to scale a second saucer (or the same one, if it were returned to him), usually from the same distance (about 10 to 15 meters, preferably about 12 meters), in an attempt to knock down the remaining pins and obtain a spare. If he failed to score the spare he would obtain his pin count or a multiple thereof, such as twice or 2.5 times the pin count (when a base of ten for scoring is used), and if he made the spare conventional bowling scoring could be employed, again with the count for the next frame being multiplied, when desired, and with such increased count being added to ten for the previous frame to score the spare. Similarly, strikes could also be scored according to such modified bowling rules. Alternatively, and in a preferred form of this invention, it has been found that when employing four or five pins, one can avoid more complicated bowling scoring by counting ten for a strike, seven for a spare and the actual number of pins knocked down when neither strike nor spare is scored. In such case, one would not have to utilize the more complex bowling scorings for strikes and spares.

To limit the travel of the flying saucer, a suitable backstop may be employed. In FIG. 1 this is shown as a series of stakes 51, driven into the ground, with the distance between them being such as would normally stop a scaled flying saucer and with the height thereof also being sufficient for such purpose. Various other forms of backstops may also be employed, such as framed backstops with elastic or other nets held between the framing members, solid walls, fencing, mattress-like blocking cushions, blankets hanging from a line, and woven or linked metal or plastic coated metal fencing material. Alternatively, bystanders can be asked to catch and return the saucers or other players can do so.

Figure 2:
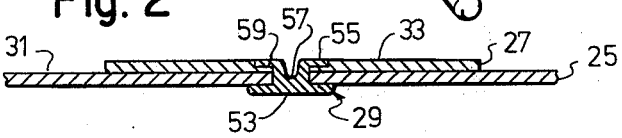
FIG. 2 is an enlarged partial sectional elevation of the supporting member of FIG. 1, taken along plane 2—2.

In FIG. 2 pivot 29 is shown as a rivet with a flat head portion 53 at the bottom thereof and a peened over retaining portion 55, connected by body or tubular portion 57. It will be noted that support 27 includes a recess 59, into which holding portion 55 fits after compression of the rivet, so that supporting surface 33 is flat and so that the upper surface of the holding portion of the rivet does not project beyond surface 33, which could interfere with the mounting of a fifth pin thereover. In the event that, after riveting, surface 55 does project too much, the excess may be ground off or the pin base shape may be changed to match it.

Figure 3:
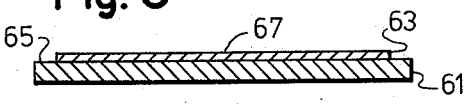
FIG. 3 is an enlarged sectional elevational view of an end portion of a modification of the supporting member of FIG. 1, wherein a magnetic or hook-and-loop fastening means or other suitable means for holding the base of a pin is mounted above the surface of a strip support.
Figure 4:
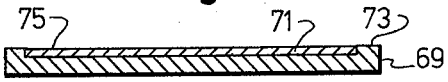
FIG. 4 is a view of another modification, corresponding to FIG. 3 but with the holding means being embedded in a depression in the supporting strip.

In FIG. 3 a support 61 has suitable holding means 63 mounted on an upper surface 65 thereof. Such holding means may be of magnetic metal, may be a magnet or may be another type of suitable holding device, such as either the hook or loop portion of a hook and loop type of plastic fastener. The upper surface 67 of the holding means is adapted to conform with the bottom of a pin so as to hold it in position so that the pin will not fall over due to irregularities in the ground or other surface on which the supporting device is placed, and will not be blown over by the wind, but is able to be knocked down by contact with the flying saucer or with a falling pin that had previously been struck by the flying saucer. In FIG. 4 numerals 69, 71, 73 and 75 correspond to the similar parts of FIG. 3 but the magnet, magnetic metal or alloy, hook or loop holding means is shown inset in the support so that a continuous upper surface results. The holding means may be held to the support by cement, adhesive, e.g., pressure sensitive adhesive, riveting, screwing or any other suitable means.

Figure 5:
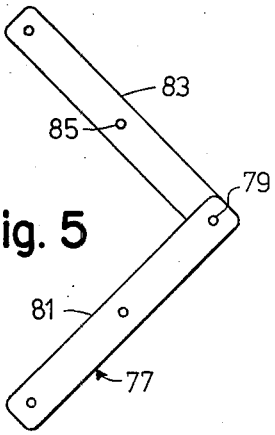
FIG. 5 is a top plan view, on a reduced scale, of a different form of support for the pins.

In FIG. 5 a modified support 77 is shown wherein pivot 79 is near the ends of supporting strips 81 and 83, resulting in a V-shaped support. As illustrated, five markings 85 are present, locating the positions where pins are to be spotted.

Figure 6:
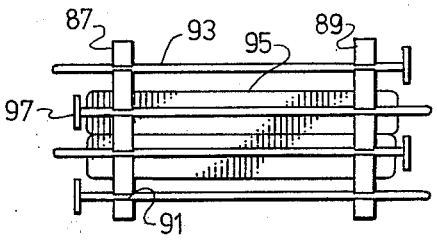
FIG. 6 is a side elevational view of a holder for a plurality of sets of pins and supports of this invention, with said pins and supports in place therein.

In FIG. 6 is shown one embodiment of a suitable holding device for pins and supports of this invention. Externally grooved and internally slotted separate holding members 87 and 89 are preferably of a material of construction of sufficient resilience so that grooves 91 therein may be made of entrance widths smaller than the pin diameters. Polystyrene and polyethylene foams may be used. Thus, when, as illustrated, four or five pins 93 are inserted in grooves of two such holding members, and four or five such pins are inserted in matching grooves in the holding members on the opposite side, the pins will act as stabilizing members, holding the unit together, and will be retained in the grooves of the holder. Before insertion of the middle pins folded supporting members 95 may be inserted through aligned central longitudinal slots (not shown) in holding members 87 and 89. Then, when the middle pins are inserted, in the manner illustrated, the base portions 97 thereof prevent accidental release of supports 95. If desired, one or more flying saucers may also be mounted within the framework created by holders 87 and 89, supports 95 and pins 93.

The cruciform or X-shaped support shown in FIG. 1 is a preferred embodiment of the support or base of this invention and usually will be in open position when the game is played, with the elongated flat strip parts thereof being at right angles and with the open end of the X being toward the player scaling the flying saucer at the target. The support will normally be of flat strip shape but other shapes may also be employed. The angles between strips need not be right angles and the target can be located so that the axis of one of the strips faces the player of the game. Also, for special effects, one strip may be longer than another and the strips need not be flat. For example, they may be arched or otherwise curved. While pivoting and foldable supports are preferred, rigid supports may also be employed. For example, in some embodiments of the broader aspects of this invention the support may be a disc with appropriate markings and mounting locations thereon, and sometimes the mounting positions may be marked on a carpet (preferably of a looped pile) or a wood or concrete surface, when the present game is to be played thereon.

The supports, when of foldable cruciform shape, may be made of any of various suitable materials, including metals, wood, cardboard, pressed wood particle board, and synthetic organic polymeric plastics. Of the metals, steel is preferred, especially when magnetic holding means are being used to position the pins on the supporting surface. When plastics are employed, such as plastic strips, they may be laminated or solid and the steel discs or other shapes of metal parts or appropriate hook-and-loop hooks and loops may be mounted on the surfaces of the strips or may be inset in them. Normally the strips will be flexible enough so that even when such mounting means are in position above the rest of the supporting surfaces of the strips, the strips will be foldable into closed position without difficulty. The various mounting means may be cemented in position, may be fused in place or may be held by any other suitable means. Especially when thermoplastic synthetic organic polymeric materials are utilized for major proportions of the strip bases, the magnetic, magnetic metal, hook or loop fasteners will often preferably be fused into position thereon.

The dimensions of the support may be modified so that combinations of pins, flying saucer and support may result in the most satisfactory game, most closely simulating bowling, and most desirably testing the skills of the players. Thus, it has been found desirable that at least four pins be employed, preferably mounted on the outer portions of the legs of an X and it is additionally desirable for a fifth pin to be mounted at the center of such X. Preferably, the end pins closer to one another will be apart a distance less than the diameter of the flying saucer and the end pins farther apart from one another will be apart a distance about the same as, or preferably, greater than the diameter of the saucer. In a preferred operation, wherein the diameter of the flying saucer is about 20 to 25 cm., e.g., 23.5 cm., the pins may be about 20 to 25 cm. apart, e.g., 23.8 cm., apart at the greater distance and 15 to 20 cm., e.g., 16.8 cm., apart at the nearer distance.

While it is desirable that the upper supporting surfaces be perfectly smooth, with the rivet or other pivot means being embedded or ground down, this is not absolutely necessary and although it is also desirable that the bottoms or bases of the pins be smooth and conform with the supporting surfaces, such conformation need not be perfect and approximate conformance results in good handling of the pins. Similarly, the rivet head extending through the bottom of the support can project somewhat without interfering with the operation of the support.

The support may be marked in any of various ways for placements of the pins thereon, as by X's, lines, boundaries, tapes, impressions, and molded-in marks, among others. It may be desirable to affix to the upper surfaces of the supports notes and information with respect to scoring rules. In some instances, rather than utilizing specific portable supports, such as those preferably employed, the support may be a concrete, wooden, metal or other suitable surface on which the various mounting indicia are present, with or without special holding means for additionally supporting the pins. Of course, use of the highly preferred, portable support allows playing of the game on any suitable surfaces, including dirt, grass, artificial turf and others which either are not level, are unsuitable for marking, or on which marking is prohibited.

The pins of this invention may be made of wood, metal, synthetic organic polymeric material or reinforced synthetic organic polymeric material, such as fiberglass reinforced polyester. As was previously mentioned, they may be rods or tubes, and preferably are cylindrical, although other cross-sectional shapes may be employed. Of the metals, aluminum is preferred for the tubular or rod structures but copper, brass and steel are also useful. Various polymeric materials, including polystyrene, polyvinyl chloride, phenol formaldehyde resins, polypropylene, low pressure polyethylene, nylon and polyacetals are also useful. Generally, it will be desirable for the pins to be light in weight. For example, even with magnets in the bases thereof, the weights will often be in the range of 15 to 50 grams, e.g., 30 grams. The pins should usually be of heights in the range of 30 to 40 cm., e.g., 36.5 cm. and of diameters in the range of 0.7 to 1.5 cm., e.g., 1 cm. The bases of the pins, to obtain desirable stability, will normally be of widths or diameters in the range of 2.5 to 3.5 cm., e.g., 2.9 cm.

The magnetic, hook and loop (often marketed under the trademark VELCRO®) holders and other means for holding the pins in desired upright position with respect to the horizontal support, will cause the pins to be held with a force greater than the ordinary force of gravity, usually greater by from 20 to 200 grams each, e.g., 50 to 100 grams. Different holding forces can be obtained with different magnets or magnetic alloys and with different hook and loop or equivalent fasteners. The force exerted holds the pins in position despite ordinary irregularities in placements of the support and despite winds, even fairly high winds, such as those of 20 to 40 km./hr. Yet, the force is not so great that a flying saucer cannot knock the pins down by contact therewith, even with comparatively light contact. When desired, the strengths of the magnetic or hook and loop holdings can be varied to increase or decrease the difficulty of striking and to change the mix of the pins. Of course, the number of pins and their locations may also be altered to accomplish such purpose. Yet, it has been found that at least four pins are highly desirable, located at the outer ends of a cross or similar configuration, and that an additional pin at the center of such cross also helps to give a good mix when one or more of the pins is struck by a flying saucer.

The flying saucer or flying disc, sometimes sold under the trademark FRISBEE, may be of any suitable size but will usually be of a diameter in the 20 to 25 cm. range, e.g., 23.8 cm. and of a weight of 110 to 140 grams, e.g., 119 g. It has been found that such size and weight result in a good simulated bowling game of this invention wherein the skill of the scaler of the flying saucer is important and is rewarded by high scores. The flying saucer is preferably made of polyethylene but other synthetic organic polymers are also useful, such as those previously described.

While the flying saucer is an important component of the present set of game items, various suitable flying saucers may be employed, so that the set may be diminished to a combination of a supporting means and a plurality of pins, to be used with a flying saucer. Of course, multiples of the components of such sets may also be used and are often highly desirable, especially for competitive games and team playing.

The present game owes much of its interest to the controllability of the flight of the flying saucer by one skilled in scaling it. Unlike bowling, wherein one must have a controlled surface on which the bowling ball is rolled, the present game can be played almost anywhere because the combination of the support and pins, which are made for stable mounting on such a support, allows both outdoor and indoor play over any of a variety of surfaces, whether smooth or irregular. Because the flying saucer path can be controlled it may be aimed at particular locations of the pin arrangement so as to obtain the best contact and pin mix and produce strikes. Windy weather conditions do not affect the maintenance of desired pin positions before scaling the flying saucer at them, and due to the comparatively low trajectory of the saucer in play, they do not usually significantly affect its path, so the game can be played under both still and windy conditions.

The present game may be played by one person but is preferably played competitively, between singles, pairs or larger teams. When played by a single player, it is possible to employ only one set of "bowling" pins, with a single holder and a single flying saucer but preferably two or more flying saucers are used, so that the player does not have to retrieve the first one in order to take his spare shot, should he fail to make a strike. When additional flying saucers are provided, e.g., 3 or 4 total, the extras may be used for practice tosses if the player fails to make a spare.

Preferably, even when the game is played by a single player, seeking to make a good score, there will be employed at least two sets of pins, two supports and two flying saucers, and a holder for these, or at least for the pins and supports, will also be used. The supports will be set up at the desired distance apart, with pins arranged on each of them in desired fashion. Then, the player, standing near one of the supports, will scale the flying saucer toward the pins mounted on the other support and will repeat this operation should he fail to make a strike. He may then walk to the target pins, pick up the flying saucers, scale them at the other target, replace the first pins and walk to the second target, where he is then ready to play the third frame of the game. These operations may then be repeated until the entire game is played out and the final score is determined. When two players are playing the game, they may set the targets up the desired distance apart and may alternately direct the flying saucer or flying saucers at the targets, with each player remaining near the other player's target and returning the scaled saucer to the other player when scaling it at his own target. Following this method, no walking by the players is required. Alternatively, double sets of targets and pins may be employed, with each player, in effect, playing as if he alone were playing, with both of them walking back and forth together, competing to obtain the better score. Team play, involving two or more players per team, may be organized accordingly.

Various modifications in the game and in the game items may be made to modify the game characteristics. For example, the game may be made easier by mounting the pins closer together, using more pins, making the pins longer (and sometimes wider), diminishing the holding forces between the support and the pin bases, diminishing the widths of the enlarged pin bases, making the pin bases irregular or making the support surfaces irregular so that the two do not match as well, diminishing the distance for the flying saucer to be scaled and increasing the flying saucer size and/or weight. Also, additional tosses of the flying saucers may be permitted. The degree of difficulty may be increased by the reverse procedures, for the most part, or by requiring certain types of scaling or tossing actions by the players. For example, it may be required that the flying saucer be skipped off the ground surface before contacting the pins or overhand or sidearm deliveries may be specified, rather than the usual backhand delivery. The players may find that they can improve their scores by utilizing curving scalings instead of straight deliveries, and in some instances the reverse may be true.

It is seen from the foregoing description that the present game, which is easy to understand and play, and utilizes simple game items and parts, is capable of a wide variety of modifications so as to appeal to various skill levels of players. Unlike the closest similar game, Frisbee golf, the present game involves a mixture of skill and luck, with additional interest being created by a wide variety of shot problems and solutions to them. It also awards bonuses for consistency and rewards the player who is capable of controlling the type of flying saucer flight, as well as the direction thereof. At the same time, it combines healthful recreation for young and old with an interesting contest. It represents a novel, useful and unobvious advance in the game and sport arts.

The invention has been described with respect to various illustrations, embodiments and descriptions thereof but is not to be limited to these because it is evident that one of skill in the art, with the present application before him, will be able utilize equivalents and substitutes without departing from the invention.

What is claimed is:

1. A set of game items for playing a simulated bowling game in which a flying saucer is scaled at a target of a plurality of pins with the object being to knock down the pins, which comprises a flying saucer, which is an aerodynamically curved flying toy of inverted saucer-like shape, a support for a plurality of pins, which support is closable to elongated flat strip form to facilitate carrying and storage, is pivotally openable to cruciform or V-shaped use position and includes flat supporting surfaces thereon, and a plurality of pins which include enlarged flat base portions with complementary flat lower mounting surfaces thereon conforming with the supporting surfaces of the supporting member for placement against such supporting surfaces to hold the pins in upright position until knocked down by contact with a flying saucer scaled at them by a player of the game.

2. A set of game items according to claim 1 wherein magnetic means are present at the pin bases and/or at the supports where the bases are mounted on them, to hold the pins in desired position before scaling of the flying saucer at them and to hold them with greater force than that due only to gravity, to prevent knocking down of the pins by only very slight contact with the flying saucer or with other pins moved by contact with the saucer or with other such moving pins.

3. A set of game items according to claim 2 wherein the support is in two parts, which are held together at pivoting means.

4. A set of game items according to claim 1 wherein hook or loop means are present at the pin bases and the other of such means are present at the supports where the bases are mounted on them, to hold the pins in desired position before scaling of the flying saucer at them and to hold them with greater force than that due only to gravity, to prevent knocking down of the pins by only very slight contact with the flying saucer or with other pins moved by contact with the saucer or with other such moving pins.

5. A set of game items according to claim 1 wherein the support is in two parts, which are held together at pivoting means.

6. A set of game items according to claim 1 wherein there are four or five pins, a support and one or two flying saucers and one or a plurality of such is used in playing the simulated bowling game.

7. A set of game items according to claim 1, including a back stop for positioning behind the pins to stop the flying saucer.

8. A set of game items for playing a simulated bowling game in which a flying saucer is scaled at a target of a plurality of pins with the object being to knock down the pins, which comprises a flying saucer, which is an aerodynamically curved flying toy of inverted saucer-like shape, a support for a plurality of pins, which support is closable to elongated flat strip form to facilitate carrying and storage, is openable to use position, includes flat supporting surfaces thereon, and is of two flat strip parts, held together in pivoting relationship at riveting means centrally positioned with respect to each of the flat strips, and a plurality of pins which include enlarged flat base portions with complementary flat lower mounting surfaces thereon conforming with the supporting surfaces of the supporting member, for placement against such supporting surfaces to hold the pins in upright position until knocked down by contact with a flying saucer scaled at them by a player of the game, with magnetic means being present at the pin bases and/or at the supports where the bases are mounted on them, to hold the pins in desired position before scaling of the flying saucer at them and to hold them with greater force than that due only to gravity, to prevent knocking down of the pins by only very slight contact with the flying saucer or with other pins moved by contact with the saucer or with other such moving pins.

9. A set of game items according to claim 8 wherein the pins are four or five in number, adapted to be mounted at marked locations near the ends of the strips and, when a fifth pin is present, it is adapted to be mounted at the midpoint of said strips, the pins each include a magnet or a magnetic metal or alloy at the base thereof and the strips each include a magnet or magnetic metal or alloy portion at ends thereof.

10. A set of game items according to claim 9 wherein the pin bases each include magnets and the supporting strips each include steel portions at the ends thereof, with the surfaces of such steel ends nearer to the positioned pins being coplanar with adjoining material of said supporting strips.

11. A set of game items according to claim 10 which comprises a total of two supports, each capable of supporting four or five pins, one to four flying saucers and eight or ten pins, so that competitors in the game may play back and forth and thus save unnecessary walking.

12. A set of game items according to claim 11, mounted on a holder therefor, which holder comprises a pair of transversely positioned holding parts, each of which has longitudinal slots therein on outer side surfaces thereof and an inner longitudinal slot therethrough, the outer longitudinal slots of the plurality of such holding parts being aligned for holding the pins and the inner slots being aligned for holding both folded closed supporting means.

13. A set of game items according to claim 11 wherein the sizes of the flying saucer, the support and the pins are such that when the pins are mounted near the farthest apart ends of the support and extend vertically, with the strips at right angles to each other, the flying saucer, in a horizontal plane, can pass between such farthest apart pins without touching them and can not pass horizontally between pins on the support strip ends which are closer together, without touching them.

14. A set of of game items according to claim 11, including one or two backstops for positioning behind the pins to stop the flying saucer.

15. A set of game items for use in playing a simulated bowling game in which a flying saucer is scaled at a target of a plurality of pins with the object being to knock down the pins, which comprises a support for a plurality of pins, which support is closable to elongated flat strip form to facilitate carrying and storage, is pivotally openable to cruciform or V-shaped use position, and includes flat supporting surfaces thereon, and a plurality of pins which include enlarged flat base portions with complementary flat lower mounting surface thereon conforming with the supporting surfaces of the support for placement against such supporting surfaces to hold the pins in upright position until knocked down by contact with a flying saucer scaled at them by a player of the game.

16. A set of game items according to claim 15 wherein the pins are each elongated tubes or rods having an enlarged base and the support for the pins, which is positioned under them, has a supporting surface conforming with the shape of the pin base.

17. A set of game items according to claim 15 mounted together in a holder for at least one such set, wherein the pins and support are so mounted in the holder that the pins assist in retaining the support in position therein.

18. A set of game items for playing a simulated bowling game in which a flying saucer is scaled at a target of a plurality of pins with the object being to knock down the pins, which comprises a flying saucer, which is an aerodynamically curved flying toy of inverted saucer-like shape, a support for a plurality of pins, which support is closable to elongated flat strip form to facilitate carrying and storage, is openable to cruciform use position and includes flat supporting surfaces thereon, and a plurality of pins which include enlarged flat base portions with complementary flat lower mounting surfaces thereon conforming with the supporting surfaces of the supporting member for placement against such supporting surfaces at the ends of the cross to hold the pins in upright position until knocked down by contact with a flying saucer scaled at them by a player of the game, with the sizes of the flying saucer, support and pins being such that when the pins are mounted near the farthest apart ends of the cross and extend vertically, the flying saucer, in a horizontal plane, can pass between such farthest apart pins without touching them and cannot pass horizontally between pins on the cross ends which are closer together without touching them.

19. A set of game items for playing a simulated bowling game in which a flying saucer is scaled at a target of a plurality of pins with the object being to knock down the pins and to score strikes, spares and count, as in the game of bowling, when such pins are knocked down, which comprises a flying saucer, which is an aerodynamically curved flying toy of inverted saucer-like shape, a support for a plurality of pins, which support is closable to elongated flat strip form to facilitate carrying and storage, is pivotally openable to cruciform use position, includes flat supporting surfaces thereon and is of two flat strip parts, held together at pivoting means centrally positioned with respect to each of the flat strips, and a plurality of pins which include enlarged flat base portions with complementary flat lower mounting surfaces thereon conforming with the supporting surfaces of the supporting member, for placement against such supporting surfaces to hold the pins in upright position until knocked down by contact with a flying saucer scaled at them by a player of the game, with magnetic means being present at the pin bases and/or at the supports where the bases are mounted on them, to hold the pins in desired position before scaling of the flying saucer at them and to hold them with greater force than that due only to gravity, to prevent knocking down of the pins by only very slight contact with the flying saucer or other pins moved by contact with the saucer or with other such moving pins.

* * * * *